US011136996B2

(12) United States Patent
Arai et al.

(10) Patent No.: US 11,136,996 B2
(45) Date of Patent: Oct. 5, 2021

(54) COMPRESSOR HOUSING AND TURBOCHARGER INCLUDING THE SAME

(71) Applicant: MITSUBISHI HEAVY INDUSTRIES ENGINE & TURBOCHARGER, LTD., Sagamihara (JP)

(72) Inventors: Takashi Arai, Tokyo (JP); Kenichiro Iwakiri, Tokyo (JP); Reiko Takashima, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 72 days.

(21) Appl. No.: 16/607,179

(22) PCT Filed: Oct. 12, 2017

(86) PCT No.: PCT/JP2017/037084
§ 371 (c)(1),
(2) Date: Oct. 22, 2019

(87) PCT Pub. No.: WO2019/073584
PCT Pub. Date: Apr. 18, 2019

(65) Prior Publication Data
US 2020/0386242 A1 Dec. 10, 2020

(51) Int. Cl.
*F04D 29/58* (2006.01)
*F04D 29/28* (2006.01)
(Continued)

(52) U.S. Cl.
CPC ..... *F04D 29/582* (2013.01); *F02B 29/04* (2013.01); *F02B 39/005* (2013.01);
(Continued)

(58) Field of Classification Search
CPC .... F04D 29/582; F04D 29/584; F04D 29/284; F04D 29/4206; F02B 39/005; F02B 29/04; F02B 29/0406; F02B 29/0443
(Continued)

(56) References Cited

U.S. PATENT DOCUMENTS 2,384,251 A * 9/1945 Hill ..... F04D 29/584 415/178
2,854,296 A * 9/1958 Eberle ..... F16C 37/00 384/476
(Continued)

FOREIGN PATENT DOCUMENTS

DE 10 2007 023 142 A1 11/2008
DE 10 2010 042 104 A1 4/2012
(Continued)

OTHER PUBLICATIONS

International Preliminary Report on Patentability and English translation of the Written Opinion of the International Searching Authority for International Application No. PCT/JP2017/037084, dated Apr. 23, 2020.
(Continued)

*Primary Examiner* — Thai Ba Trieu
(74) *Attorney, Agent, or Firm* — Birch, Stewart, Kolasch & Birch, LLP

(57) ABSTRACT

A compressor housing accommodating a compressor wheel for compressing intake air supplied to an engine has therein an outer cooling passage extending along a circumferential direction on an outer circumferential side of a scroll passage of a spiral shape through which the intake air compressed by the compressor wheel flows, and an inner cooling passage extending along the circumferential direction on an inner circumferential side of the scroll passage. The inner cooling passage is separated from the outer cooling passage by a
(Continued)

separation wall extending along the circumferential direction.

14 Claims, 11 Drawing Sheets

(51) Int. Cl.
*F04D 29/42* (2006.01)
*F02B 39/00* (2006.01)
*F02B 29/04* (2006.01)

(52) U.S. Cl.
CPC ..... *F04D 29/284* (2013.01); *F04D 29/4206* (2013.01); *F02B 29/0406* (2013.01)

(58) Field of Classification Search
USPC ..... 415/204; 60/605.1, 605.3, 599; 123/559.1, 41.31
See application file for complete search history.

(56) References Cited

U.S. PATENT DOCUMENTS 3,829,235 A * 8/1974 Woollenweber, Jr. ..... F04D 29/584 415/143
6,238,179 B1 * 5/2001 Wunderwald ..... F04D 29/5846 415/116
6,257,834 B1 * 7/2001 Bremer ..... F01D 25/12 415/176
6,416,281 B1 * 7/2002 Bremer ..... F04D 29/284 415/116
8,621,865 B2 * 1/2014 Mehring ..... F01D 25/14 60/605.3
9,828,873 B2 * 11/2017 Maeda ..... F04D 29/582
10,393,072 B2 * 8/2019 Segawa ..... F02B 39/005
10,487,722 B2 * 11/2019 Hu ..... F04D 29/584
10,738,795 B2 * 8/2020 Karwat ..... F04D 29/584
2015/0270566 A1 * 9/2015 Lee ..... F04D 29/584 415/175
2015/0345515 A1 * 12/2015 Isogai ..... F04D 29/284 415/115
2016/0076432 A1 * 3/2016 Kindi ..... F02B 39/005 60/605.1
2016/0273548 A1 * 9/2016 Uesugi ..... F04D 29/584
2016/0273551 A1 * 9/2016 Uesugi ..... F04D 29/584
2019/0226496 A1 * 7/2019 Arakawa ..... F04D 29/584

FOREIGN PATENT DOCUMENTS

GB 1448252 A * 9/1976 ..... F02B 29/0406
JP 50-143915 A 11/1975
JP 1-76598 U 5/1989
JP 2003-35153 A 2/2003
JP 2010-209846 A 9/2010
JP 2015-48801 A 3/2015
JP 5974886 B2 8/2016
JP 6011423 B2 10/2016
KR 101 038 369 B1 6/2011

OTHER PUBLICATIONS

International Search Report dated Dec. 26, 2017, for International Application No. PCT/JP2017/037084.
Office Action dated Jul. 21, 2020 issued in counterpart Japanese Application No. 2019-547869 with Machine Translation.
Office Action dated Jun. 9, 2020 issued in counterpart Chinese Application No. 201780090070.2.
Extended European Search Report dated Mar. 23, 2021 issued in the corresponding European Application No. 17928774.3.

* cited by examiner

COMPRESSOR HOUSING AND TURBOCHARGER INCLUDING THE SAME

CROSS-REFERENCE TO RELATED APPLICATION

This application is a National Stage of International Application No. PCT/JP2017/037084 filed Oct. 12, 2017, the contents of each application being herein incorporated by reference in its entirety.

TECHNICAL FIELD

The present disclosure relates to a compressor housing accommodating a compressor wheel for compressing intake air supplied to an engine, and a turbocharger including the compressor housing.

BACKGROUND ART

A turbocharger includes a compressor for compressing intake air supplied to an engine. When the air is compressed, the temperature rises. If the hot compressed air is supplied to the engine as it is, knocking may occur, which reduces the output and the fuel consumption. Therefore, an intercooler is provided for cooling the compressed air before being supplied to the engine.

On the other hand, recent engines are becoming more motorized to improve the fuel consumption, and more batteries and electrical components are mounted in the engine room. Thus, it is desired to save the space for the intercooler. To achieve both the cooling performance for the compressed air and the space saving of the intercooler, it is conceivable to improve the cooling efficiency of the intercooler itself, or decrease the temperature of the compressed air before flowing into the intercooler, i.e., decrease the temperature of the compressed air flowing out of the turbocharger. Further, since the temperature rises upon compression of the air, the heated compressor housing increases the temperature of air sucked into the compressor wheel and air under compression by the compressor wheel. Thus, the compressor performance is decreased compared with the case where the air is not heated. To prevent this problem, it is conceivable to prevent heat transfer by providing a heat insulator or to reduce the amount of heat transfer by decreasing the temperature of the compressor housing.

In Patent Documents 1 and 2, a cooling passage surrounding a scroll passage of a spiral shape, through which the compressed air passes, is formed in the compressor housing of the turbocharger, so that the temperature of the compressed air out of the turbocharger is decreased, and the compressor efficiency is improved.

CITATION LIST

Patent Literature

Patent Document 1: DE102007023142A
Patent Document 2: DE102010042104A

SUMMARY

Problems to be Solved

Since the cooling passage in Patent Documents 1 and 2 is formed so as to surround the scroll passage, it extends very long along the cross-sectional shape of the scroll passage.

Accordingly, this cooling passage has some problems: for instance, when a coolant such as cooling water passes through the cooling passage, many stagnation points are formed; or when a coolant flows through the cooling passage having a large flow-path cross-sectional area, the flow rate is reduced, and the cooling efficiency is reduced.

In view of the above, an object of at least one embodiment of the present disclosure is to provide a compressor housing and a turbocharger including the compressor housing whereby it is possible to efficiently cool the compressed air in the turbocharger.

Solution to the Problems (1) According to at least one embodiment of the present invention, a compressor housing for accommodating a compressor wheel for compressing intake air supplied to an engine has therein: an outer cooling passage extending along a circumferential direction on an outer circumferential side of a scroll passage of a spiral shape through which the intake air compressed by the compressor wheel flows; and an inner cooling passage extending along the circumferential direction on an inner circumferential side of the scroll passage and separated from the outer cooling passage by a separation wall extending along the circumferential direction.

With the above configuration (1), since the separation wall separates the outer cooling passage extending along the circumferential direction on the outer circumferential side of the scroll passage from the inner cooling passage extending along the circumferential direction on the inner circumferential side of the scroll passage, a range where the outer cooling passage and the inner cooling passage extend along the cross-sectional shape of the scroll passage is reduced compared with the case where the cooling passage is formed so as to surround the scroll passage from the inner peripheral side to the outer peripheral side of the scroll passage. Thus, the formation of a stagnation point is suppressed when a coolant flows through the outer cooling passage and the inner cooling passage each, and a reduction in flow rate of the coolant is suppressed, so that the cooling efficiency for the compressed air is improved. As a result, since the compressed air in the scroll passage is efficiently cooled by a coolant flowing through the outer cooling passage and the inner cooling passage from both the outer circumferential side and the inner circumferential side of the scroll passage, it is possible to efficiently cool the compressed air in the turbocharger.

(2) In some embodiments, in the above configuration (1), the outer cooling passage includes a curved passage portion having a cross-sectional shape curved along a cross-sectional shape of the scroll passage in a cross-section along a rotational axis of the compressor wheel.

With the above configuration (2), since the curved passage portion has a cross-sectional shape curved along the cross-sectional shape of the scroll passage, the distance between the curved passage portion and the scroll passage is reduced as much as possible along the cross-sectional shape of the scroll passage. Thus, it is possible to efficiently cool the compressed air.

(3) In some embodiments, in the above configuration (2), the outer cooling passage further includes a flat passage portion having a cross-sectional shape extending flat from at least one of both edges of the curved passage portion in a direction along the cross-sectional shape of the scroll passage in the cross-section along the rotational axis of the compressor wheel.

The compressor housing is produced by filling a mold with powder and heating and solidifying it into the shape of the compressor housing. If a portion extending from an edge of the curved passage portion is curved, it is difficult to open the mold. However, with the above configuration (3), since the flat passage portion having a cross-sectional shape extending flat from the edge of the curved passage portion is formed, it is easy to open the mold, so that the productivity of the compressor housing is improved.

(4) In some embodiments, in any one of the above configurations (1) to (3), the inner cooling passage has a cross-sectional shape curved along a cross-sectional shape of the scroll passage in a cross-section along a rotational axis of the compressor wheel.

With the above configuration (4), since the inner cooling passage has a cross-sectional shape curved along the cross-sectional shape of the scroll passage, the distance between the inner cooling passage and the scroll passage is reduced as much as possible along the cross-sectional shape of the scroll passage. Thus, it is possible to efficiently cool the compressed air.

(5) In some embodiments, in any one of the above configurations (1) to (4), when, in a cross-section along a rotational axis of the compressor wheel, a linear direction which passes through a gravity center position of a cross-section of the inner cooling passage and in which the cross-section of the inner cooling passage has a maximum length is defined as a reference longitudinal direction, the reference longitudinal direction is a direction along the rotational axis of the compressor wheel.

With the above configuration (5), since the reference longitudinal direction in which the cross-section of the inner cooling passage has the maximum length is a direction along the rotational axis of the compressor wheel, the coolant flowing through the inner cooling passage reduces heat transfer from the hot compressed air in the scroll passage to air to be sucked into the compressor wheel and air to be compressed by the compressor wheel. Thus, it is possible to improve the compressor performance.

(6) In some embodiments, in the above configuration (5), the compressor housing further has therein a diffuser passage communicating with the scroll passage and extending inward in a radial direction of the compressor wheel from the scroll passage, and, when a direction perpendicular to the reference longitudinal direction is defined as a width direction, a maximum portion of the inner cooling passage in the width direction is positioned on a side of the diffuser passage with respect to the gravity center position.

With the above configuration (6), since a portion of the inner cooling passage with a maximum cooling area is positioned closer to the diffuser passage, the compressed air cooling effect in the diffuser passage is improved, and a portion around the compressor wheel can also be cooled. Thus, it is possible not only to decrease the temperature of the compressed air, but also to improve the compressor performance.

(7) In some embodiments, in the above configuration (5), the compressor housing further has therein a diffuser passage communicating with the scroll passage and extending inward in a radial direction of the compressor wheel from the scroll passage, and, when a direction perpendicular to the reference longitudinal direction is defined as a width direction, a maximum portion of the inner cooling passage in the width direction is positioned on a side opposite to the diffuser passage with respect to the gravity center position.

With the above configuration (7), since a portion of the inner cooling passage with a maximum cooling area (maximum portion) is positioned along the cross-sectional shape of the scroll passage, and the cooling area is also effective for the diffuser passage, the compressed air cooling effect is improved. Thus, it is possible to efficiently cool the compressed air.

(8) In some embodiments, in any one of the above configurations (5) to (7), a width of the inner cooling passage in a direction perpendicular to the reference longitudinal direction is equal to or larger than that of the outer cooling passage.

With the above configuration (8), since the inner cooling passage has a larger heat transfer area on a side closer to the diffuser passage, it is possible to improve the compressed air cooling effect in the diffuser passage.

(9) In some embodiments, in any one of the above configurations (1) to (8), the compressor housing comprises at least two first communication holes connecting the outer cooling passage to outside of the compressor housing; and at least two second communication holes connecting the inner cooling passage to outside of the compressor housing.

With the above configuration (9), since each of the outer cooling passage and the inner cooling passage has at least two communication holes, it is possible to arrange the outlets and the inlets of the outer cooling passage and the inner cooling passage in accordance with the layout of an engine room in which the turbocharger is mounted. Further, the first communication holes and the second communication holes are used to hold a core during casting of the compressor housing. When two or more first communication holes and two or more second communication holes exist, it is possible to improve the core holding capacity.

(10) In some embodiments, in the above configuration (9), at least one of the at least two first communication holes and the at least two second communication holes opens vertically upward when the compressor housing is attached to the engine.

In the case where the coolant flowing through the outer cooling passage and the inner cooling passage is liquid, the coolant may boil by cooling the compressed air in the scroll passage. If the coolant boils, unless the steam of the coolant is discharged from the outer cooling passage and the inner cooling passage, the flow of the coolant is blocked, interrupting cooling of the compressed air. However, with the above configuration (10), since at least one of the first communication hole or the second communication hole opens vertically upward, the steam of the coolant can be discharged from the outer cooling passage and the inner cooling passage via the communication hole opening vertically upward.

(11) In some embodiments, in the above configuration (9) or (10), openings of the first communication holes make a 90-degree angle with openings of the second communication holes.

In the case where the turbocharger is placed so that the rotational axis of the compressor wheel is oriented to the vertical direction or the horizontal direction, with the above configuration (11), since at least one of the first communication hole or the second communication hole opens vertically upward, the steam of the coolant can be discharged from the outer cooling passage and the inner cooling passage via the communication hole opening vertically upward.

(12) In some embodiments, in any one of the above configurations (9) to (11), one of the at least two first communication holes is an inlet of a coolant flowing through the outer cooling passage, and another one of the at least two first communication holes is an outlet of the coolant flowing through the outer cooling passage, and one of the at least two second communication holes is an inlet of a coolant flowing through the inner cooling passage, and another one of the at least two second communication holes is an outlet of the coolant flowing through the inner cooling passage.

With the above configuration (12), since the coolant flows through each of the outer cooling passage and the inner cooling passage, the cooling performance for the compressed air in the scroll passage is improved. Thus, it is possible to more efficiently cool the compressed air.

(13) In some embodiments, in any one of the above configurations (1) to (8), an outlet of a coolant flowing through the outer cooling passage is joined with an outlet of a coolant flowing through the inner cooling passage.

With the above configuration (13), since the outer cooling passage and the inner cooling passage share the single outlet, it is possible to reduce the cost of a core used for casting the compressor housing, and it is also possible to improve the core holding capacity, compared with the case where each of the outer cooling passage and the inner cooling passage has an inlet and an outlet.

(14) In some embodiments, in any one of the above configurations (1) to (8), an inlet of a coolant flowing through the outer cooling passage is directly connected to an outlet of a coolant flowing through the inner cooling passage, or an outlet of a coolant flowing through the outer cooling passage is directly connected to an inlet of a coolant flowing through the inner cooling passage.

With the above configuration (14), without using either a connection pipe connecting the inlet of the outer cooling passage to the outlet of the inner cooling passage or a connection pipe connecting the outlet of the outer cooling passage to the inlet of the inner cooling passage, the outer cooling passage and the inner cooling passage can form a single continuous cooling passage. Thus, it is possible to downsize the turbocharger.

(15) A turbocharger according to at least one embodiment of the present invention comprises: the compressor housing described in any one of the above (1) to (14).

With the above configuration (15), it is possible to efficiently cool the compressed air in the scroll passage by the coolant flowing through each of the outer cooling passage and the inner cooling passage formed in the compressor housing.

Advantageous Effects

According to at least one embodiment of the present disclosure, since the separation wall separates the outer cooling passage extending along the circumferential direction on the outer circumferential side of the scroll passage from the inner cooling passage extending along the circumferential direction on the inner circumferential side of the scroll passage, a range where the outer cooling passage and the inner cooling passage extend along the cross-sectional shape of the scroll passage is reduced compared with the case where the cooling passage is formed so as to surround the scroll passage from the inner peripheral side to the outer peripheral side of the scroll passage. Thus, the formation of a stagnation point is suppressed when a coolant flows through the outer cooling passage and the inner cooling passage each, and a reduction in flow rate of the coolant is suppressed, so that the cooling efficiency for the compressed air is improved. As a result, since the compressed air in the scroll passage is efficiently cooled by a coolant flowing through the outer cooling passage and the inner cooling passage from both the outer circumferential side and the inner circumferential side of the scroll passage, it is possible to efficiently cool the compressed air in the turbocharger.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

First Embodiment

Figure 1:
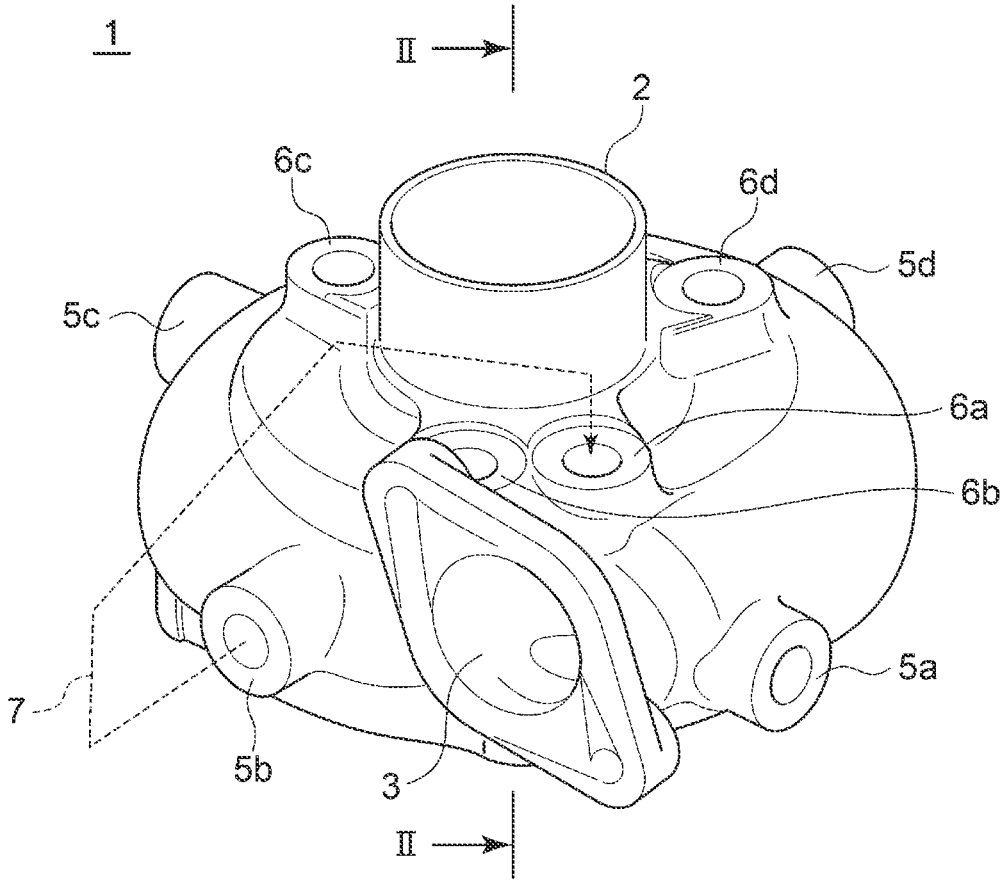
FIG. 1 is a perspective view of a compressor housing according to a first embodiment of the present disclosure.

As shown in FIG. 1, a compressor housing 1 of a turbocharger includes a cylindrical air inlet part 2 into which air to be compressed by a compressor wheel (not shown) flows. The compressor housing 1 has a scroll passage 3 of a spiral shape formed around the air inlet part 2. The compressed air compressed by the compressor wheel flows through the scroll passage 3 and out of the turbocharger and then supplied to an engine (not shown). The cross-sectional area of the scroll passage 3 increases along the flowing direction of the compressed air, i.e., from the inlet side to the outlet side of the scroll passage 3.

Figure 2:
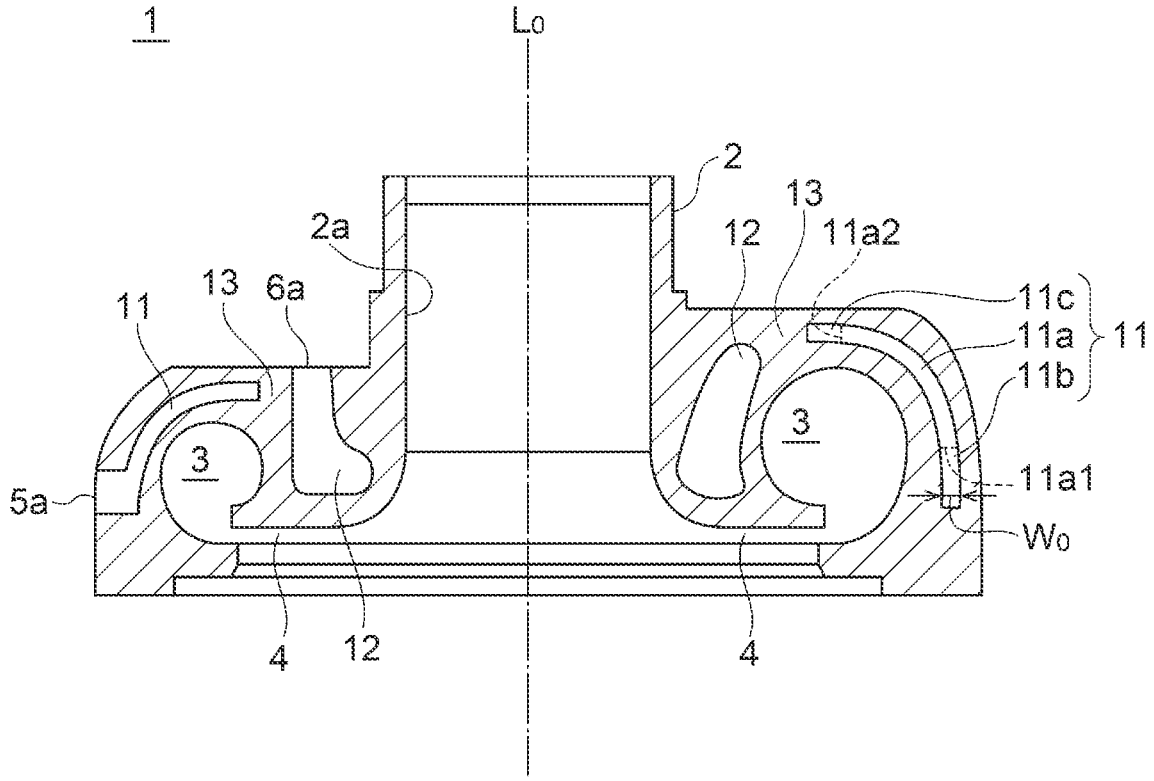
FIG. 2 is a cross-sectional view taken along line II-II in FIG. 1.

As shown in FIG. 2, the compressor housing 1 has a diffuser passage 4 connecting an air passage 2*a* inside the air inlet part 2 and the scroll passage 3 so as to extend inward in the radial direction of the compressor housing (not shown) from the scroll passage 3. Further, the compressor housing 1 has an outer cooling passage 11 extending along the circumferential direction on the outer circumferential side of the scroll passage 3 and an inner cooling passage 12 extending along the circumferential direction on the inner circumferential side of the scroll passage 3. As cooling water as a coolant flows through each of the outer cooling passage 11 and the inner cooling passage 12, the compressed air flowing through the scroll passage 3 is cooled. The outer cooling passage 11 and the inner cooling passage 12 are separated by a separation wall 13 extending along the circumferential direction in the compressor housing 1.

As shown in FIG. 1, the compressor housing 1 includes four first communication holes 5*a*, 5*b*, 5*c*, 5*d* connecting the outer cooling passage 11 (see FIG. 2) to the outside of the compressor housing 1 and four second communication holes 6*a*, 6*b*, 6*c*, 6*d* connecting the inner cooling passage 12 (see FIG. 2) to the outside of the compressor housing 1. Openings of the first communication holes 5*a*, 5*b*, 5*c*, 5*d* make a 90-degree angle with openings of the second communication holes 6*a*, 6*b*, 6*c*, 6*d*.

The first communication hole 5*a* forms an inlet for introducing cooling water into the outer cooling passage 11, and the first communication hole 5*b* forms an outlet for discharging cooling water from the outer cooling passage 11. The second communication hole 6*a* forms an inlet for introducing cooling water into the inner cooling passage 12, and the second communication hole 6*b* forms an outlet for discharging cooling water from the inner cooling passage 12. The first communication hole 5*b* and the second communication hole 6*a* are connected by a connection pipe 7. That is, the outer cooling passage 11 and the inner cooling passage 12 are connected via the connection pipe 7.

As shown in FIG. 2, the outer cooling passage 11 includes a curved passage portion 11*a* having a cross-sectional shape curved along the cross-sectional shape of the scroll passage 3 in a cross-section along the rotational axis $L_0$ of the compressor wheel, and flat passage portions 11*b*, 11*c* having a cross-sectional shape extending flat from both edges 11*a*1, 11*a*2 of the curved passage portion 11*a* in a direction along the cross-sectional shape of the scroll passage 3. The outer cooling passage 11 has a constant width $W_0$ along the cross-sectional shape of the scroll passage 3. Although in the first embodiment, the width of the outer cooling passage 11 is constant at $W_0$, in other embodiments, the width of the outer cooling passage 11 may vary in the direction along the cross-sectional shape of the scroll passage 3.

Figure 3:
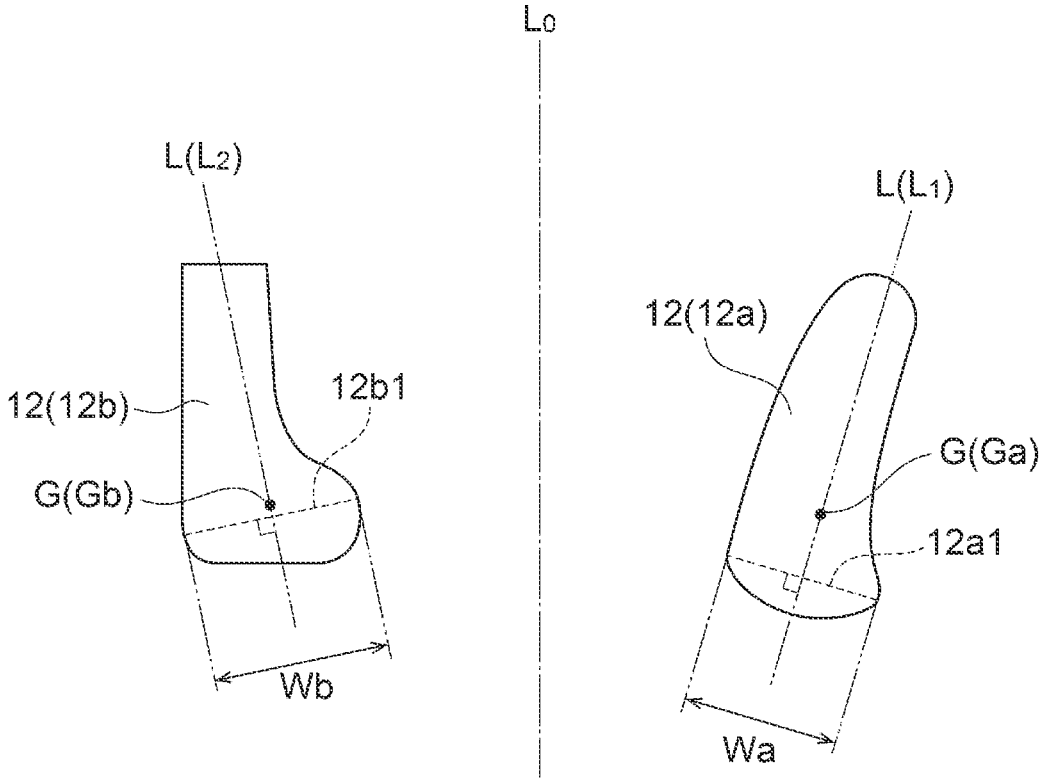
FIG. 3 is a diagram for describing a detailed shape of an inner cooling passage formed in the compressor housing according to the first embodiment of the present disclosure.

As shown in FIG. 3, when, in a cross-section along the rotational axis $L_0$ of the compressor wheel, a linear direction which passes through a gravity center position G of a cross-section of the inner cooling passage 12 and in which the cross-section of the inner cooling passage 12 has a maximum length is defined as a reference longitudinal direction L, the reference longitudinal direction L is a direction along the rotational axis $L_0$ of the compressor wheel. Here, the direction along the rotational axis $L_0$ of the compressor wheel means that the angle θ between the rotational axis $L_0$ of the compressor wheel and the reference longitudinal direction L is less than 45°.

In a direction in which the compressed air flows through the scroll passage 3 (see FIG. 2), a cross-section 12*a* of the inner cooling passage 12 is closer to the outlet of the scroll passage 3, and a cross-section 12*b* of the inner cooling passage 12 is closer to the inlet of the scroll passage 3. A linear direction which passes through a gravity center position $G_a$ of the cross-section 12*a* of the inner cooling passage 12 and in which the cross-section 12*a* of the inner cooling passage 12 has a maximum length is defined as a reference longitudinal direction L1. Further, a linear direction which passes through a gravity center position $G_b$ of the cross-section 12*b* of the inner cooling passage 12 and in which the cross-section 12*b* of the inner cooling passage 12 has a maximum length is defined as a reference longitudinal direction L2.

In each of the cross-sections 12*a*, 12*b* of the inner cooling passage 12, a direction perpendicular to the reference longitudinal direction $L_1$, $L_2$ is defined as a width direction. In each of the cross-sections 12*a*, 12*b*, a maximum portion 12*a*1, 12*b*1 of the width of the inner cooling passage 12 (respective lengths are represented by $W_a$, $W_b$) is positioned on a side of the diffuser passage 4 (see FIG. 2) with respect to the gravity center position $G_a$, $G_b$. That is, the maximum portion of the inner cooling passage 12 in the width direction is positioned closer to the diffuser passage 4 over a range from the inlet to the outlet of the scroll passage 3.

Further, the inner cooling passage 12 is configured such that the width of the inner cooling passage 12 is larger than the width $W_0$ (see FIG. 2) of the outer cooling passage 11. With this configuration, since the inner cooling passage 12 has a larger heat transfer area on a side closer to the diffuser passage 4, it is possible to improve the compressed air cooling effect in the diffuser passage 4.

Next, the cooling operation by cooling water in the compressor housing 1 according to the first embodiment will be described.

As shown in FIG. 1, cooling water flows into the outer cooling passage 11 (see FIG. 2) via the first communication hole 5*a* which is an inlet of cooling water. The cooling water flows through the outer cooling passage 11 and then flows out of the outer cooling passage 11 via the first communication hole 5*b* which is an outlet of cooling water. The cooling water out of the outer cooling passage 11 passes through the connection pipe 7 and flows into the inner cooling passage 12 (see FIG. 2) via the second communication hole 6*a* which is an inlet of cooling water. The cooling water flows through the inner cooling passage 12 and then flows out of the inner cooling passage 12 via the second communication hole 6*b* which is an outlet of cooling water.

As shown in FIG. 2, air flowing through the air passage 2*a* is compressed by the compressor wheel (not shown) into compressed air and flows through the diffuser passage 4 into the scroll passage 3. When the compressed air flows through the scroll passage 3 in the compressor housing 1, cooling water flowing through the outer cooling passage 11 cools the air from the outer circumferential side of the scroll passage 3, while cooling water flowing through the inner cooling passage 12 cools the air from the inner circumferential side of the scroll passage 3. The compressed air having passed through the scroll passage 3 then flows out of the compressor of the turbocharger. Then, the compressed air is cooled by an intercooler (not shown) and is supplied to an engine (not shown).

Since the compressed air is cooled by cooling water flowing through the outer cooling passage 11 and the inner cooling passage 12, the compressed air at an appropriate temperature enters the intercooler. Thus, it is possible to reduce the cooling performance required in the intercooler, and it is possible to downsize the intercooler. As a result, it is possible to save the space of the intercooler.

As described above, since the separation wall 13 separates the outer cooling passage 11 from the inner cooling passage 12, a range where the outer cooling passage 11 and the inner cooling passage 12 extend along the cross-sectional shape of the scroll passage 3 is reduced compared with the case where the cooling passage is formed so as to surround the scroll passage 3 from the inner peripheral side to the outer peripheral side of the scroll passage 3. Thus, the formation of a stagnation point is suppressed when cooling water flows through the outer cooling passage 11 and the inner cooling passage 12 each, and a reduction in flow rate of cooling water is suppressed, so that the cooling efficiency for the compressed air is improved. As a result, since the compressed air in the scroll passage 3 is efficiently cooled by cooling water flowing through the outer cooling passage 11 and the inner cooling passage 12 from both the outer circumferential side and the inner circumferential side of the scroll passage 3, it is possible to efficiently cool the compressed air in the turbocharger.

Further, as described above, the outer cooling passage 11 includes the curved passage portion 11*a* having a cross-sectional shape curved along the cross-sectional shape of the scroll passage 3. Accordingly, since the distance between the curved passage portion 11*a* and the scroll passage 3 is reduced as much as possible along the cross-sectional shape of the scroll passage 3, it is possible to efficiently cool the compressed air.

Further, as described above, the reference longitudinal direction L in which the length is maximized in a cross-section of the inner cooling passage 12 is along the rotational axis $L_0$ of the compressor wheel. With this configuration, as shown in FIG. 2, since cooling water flowing through the inner cooling passage 12 reduces heat transfer from the compressed air at high temperature in the scroll passage 3 to air in the air passage 2*a*, i.e., air to be compressed by the compressor wheel (not shown), it is possible to improve the compressor performance.

Further, as described above, the maximum portion 12*a*1, 12*b*1 of the inner cooling passage 12 in the width direction is positioned closer to the diffuser passage 4 over a range from the inlet to the outlet of the scroll passage 3. Thus, it is possible to improve the cooling effect for the compressed air in the diffuser passage 4.

Next, results of experiment regarding the compressed air cooling effect and the compressor performance improvement effect will be described.

Experiment was performed on a turbocharger including a compressor housing 1 according to the second embodiment described later. For each of the operating conditions in which the rotational speed of the compressor wheel is high, middle, or low, the supply condition of air supplied to the air passage 2*a* (see FIG. 2) was varied so that the compressor works in the vicinity of a surge region, in the vicinity of a choke region, or a peak region with the best compressor efficiency. In the air passage 2*a*, the atmospheric pressure is kept as much as possible, and the temperature on the turbine side of the turbocharger is fixed at 600° C.

In the operating condition in which the rotational speed of the compressor wheel is high, the temperature of the compressed air discharged from the turbocharger was measured in five cases: cooling water at 50° C. flows through only the inner cooling passage 12 (see FIG. 6) at a flow rate of 6 L/min; the same flows through only the outer cooling passage 11 (see FIG. 2); the same flows through the inner cooling passage 12 and then the outer cooling passage 11; the same flows through the outer cooling passage 11 and then the inner cooling passage 12; and the same flows through neither the outer cooling passage 11 nor the inner cooling passage 12. The measurement results, i.e., experimental results regarding the compressed air cooling effect are shown in FIG. 4.

Figure 4:
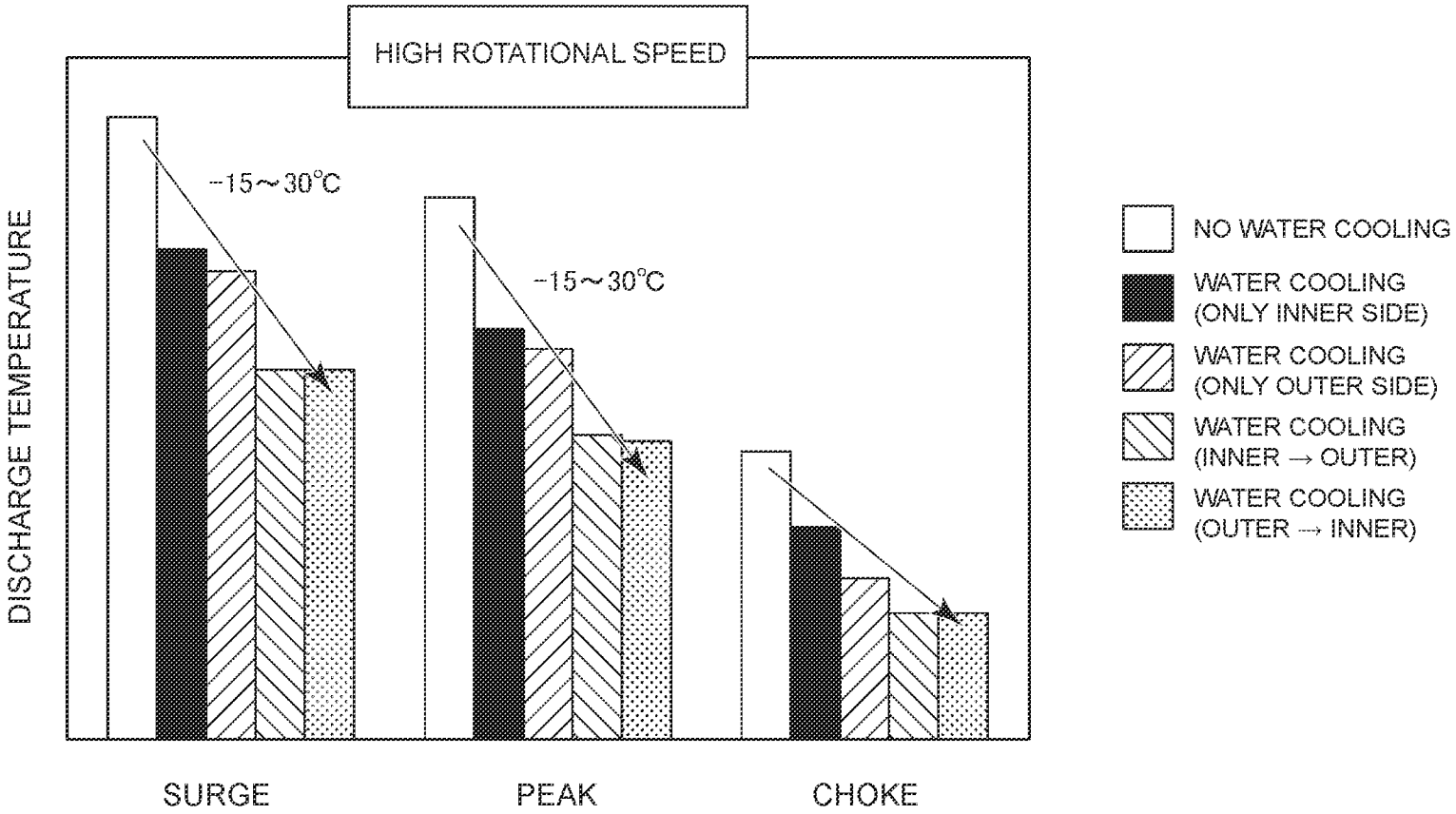
FIG. 4 is a graph showing experimental results regarding a compressed air cooling effect in a turbocharger including a compressor housing according to a second embodiment of the present disclosure.

As seen from FIG. 4, it was revealed that cooling by cooling water flowing through at least one of the outer cooling passage 11 or the inner cooling passage 12 reduces the temperature of the compressed air discharged from the turbocharger compared with not cooling. In addition, it was revealed that the compressed air cooling effect is increased in the case where cooling water flows through both the outer cooling passage 11 and the inner cooling passage 12, compared with the case where cooling water flows through one of the outer cooling passage 11 or the inner cooling passage 12.

Figure 5:
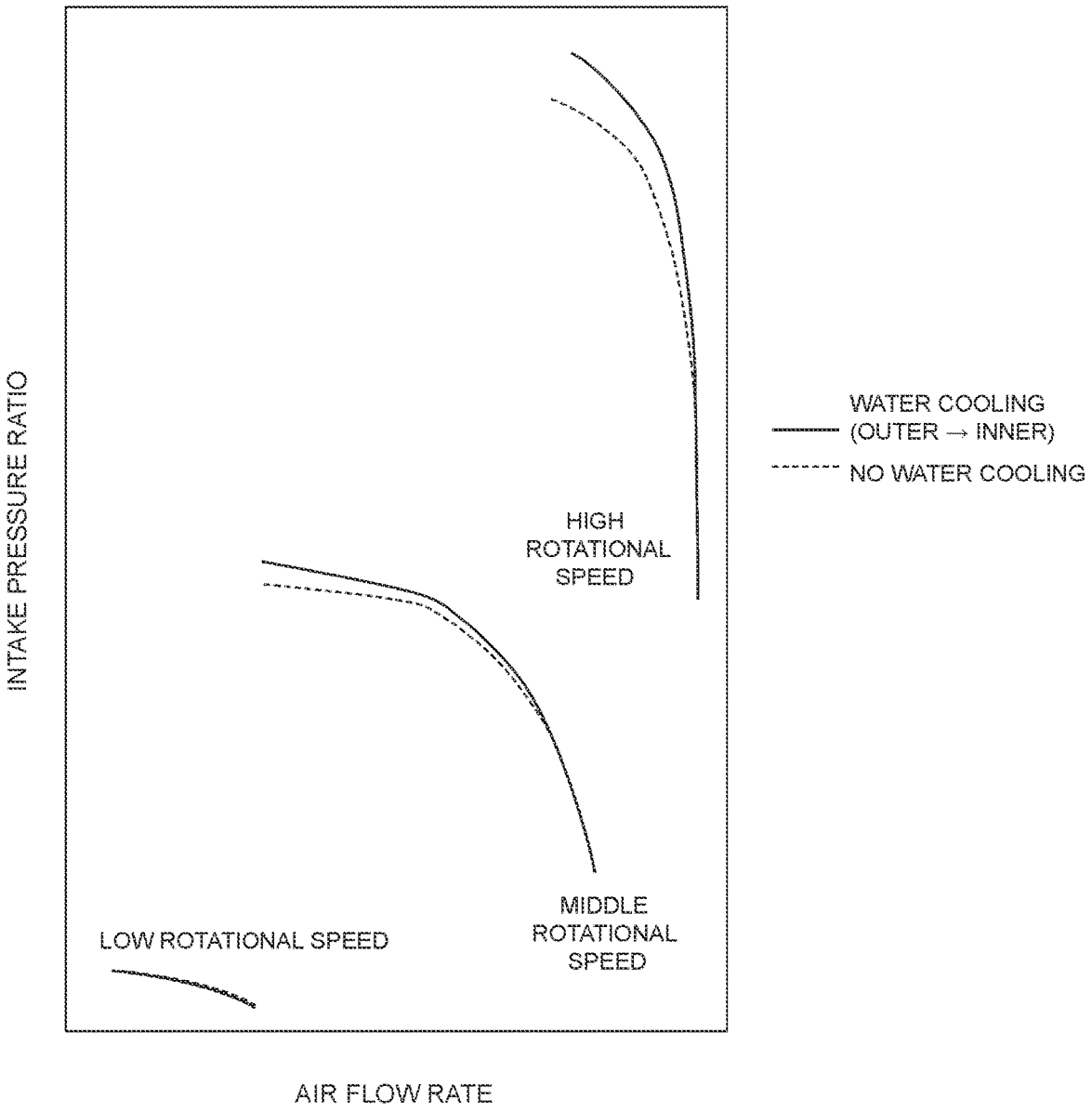
FIG. 5 is a graph showing experimental results regarding a compressor performance improvement effect in a turbocharger including a compressor housing according to the second embodiment of the present disclosure.

Further, the intake pressure ratio, i.e., a ratio of pressure at the outlet to pressure at the inlet of the compressor, against the air supply amount to the compressor is measured for each of the case where cooling water flows through neither the outer cooling passage 11 nor the inner cooling passage 12, and the case where cooling water flows through the outer cooling passage 11 and then the inner cooling passage 12. The measurement results, i.e., experimental results regarding the compressor performance improvement effect are shown in FIG. 5.

Although there is no significant difference when the rotational speed of the compressor wheel is low, when the rotational speed of the compressor wheel is middle or high, the intake pressure ratio is increased in the case where cooling water flows through the outer cooling passage 11 and then the inner cooling passage 12, compared with the case where cooling water flows through neither the outer cooling passage 11 nor the inner cooling passage 12. From these results, it was revealed that the compressor performance is increased by cooling the compressed air.

As described above, since the separation wall 13 separates the outer cooling passage 11 extending along the circumferential direction on the outer circumferential side of the scroll passage 3 from the inner cooling passage 12 extending along the circumferential direction on the inner circumferential side of the scroll passage 3, a range where the outer cooling passage 11 and the inner cooling passage 12 extend along the cross-sectional shape of the scroll passage 3 is reduced compared with the case where the cooling passage is formed so as to surround the scroll passage 3 from the inner peripheral side to the outer peripheral side of the scroll passage 3. Thus, the formation of a stagnation point is suppressed when cooling water flows through the outer cooling passage 11 and the inner cooling passage 12 each, and a reduction in flow rate of cooling water is suppressed, so that the cooling efficiency for the compressed air is improved. As a result, since the compressed air in the scroll passage 3 is efficiently cooled by cooling water flowing through the outer cooling passage 11 and the inner cooling passage 12 from both the outer circumferential side and the inner circumferential side of the scroll passage 3, it is possible to efficiently cool the compressed air in the turbocharger.

In the first embodiment, when the compressed air in the scroll passage 3 is cooled by cooling water flowing through the outer cooling passage 11 and the inner cooling passage 12, the cooling water may boil. In this case, unless the steam is discharged from the outer cooling passage 11 and the inner cooling passage 12, the flow of cooling water is blocked, interrupting cooling of the compressed air. However, in the first embodiment, since the openings of the first communication holes 5*a* to 5*d* make a 90 degree angle with the openings of the second communication holes 6*a* to 6*d*, in the case where the turbocharger is placed so that the rotational axis $L_0$ of the compressor wheel is oriented to the vertical direction or the horizontal direction, one of the first communication holes 5*a* to 5*d* and the second communication holes 6*a* to 6*d* opens vertically upward. By providing, for instance, a pressure control valve in the communication hole that opens vertically upward, the pressure control vale opens as the pressure of the steam increases and allows the steam to be discharged from the outer cooling passage 11 and the inner cooling passage 12 via the communication hole.

As long as the steam is discharged from the outer cooling passage 11 and the inner cooling passage 12, the angle between the openings of the first communication holes 5*a* to 5*d* and the openings of the second communication holes 6*a* to 6*d* is not limited to 90 degree. If the direction of each communication hole is freely selected, it may be designed so that at least one of the first communication holes 5*a* to 5*d* and the second communication holes 6*a* to 6*d* opens vertically upward when the compressor housing 1 is attached to the engine.

Further, although the number of the first communication holes and the number of the second communication holes are four each, their numbers are not limited to four. The number of the first communication holes and the number of the second communication holes are at least two each. When each of the outer cooling passage 11 and the inner cooling passage 12 has at least two communication holes, it is possible to arrange the outlets and the inlets of the outer cooling passage 11 and the inner cooling passage 12 in accordance with the layout of an engine room in which the turbocharger is mounted. Further, the first communication hole and the second communication hole are used to hold a core during casting of the compressor housing. When two or more first communication holes and two or more second communication holes exist, it is possible to improve the core holding capacity.

In the first embodiment, as described above, the outer cooling passage 11 includes flat passage portions 11*b*, 11*c* having a cross-sectional shape extending flat from both edges 11*a*1, 11*a*2 of the curved passage portion 11*a* in a direction along the cross-sectional shape of the scroll passage 3 in a cross-section along the rotational axis $L_0$ of the compressor wheel. The compressor housing 1 is produced by filling a mold with powder and heating and solidifying it into the shape of the compressor housing 1. If portions extending from both edges 11*a*1, 11*a*2 of the curved passage portion 11*a* are curved, it is difficult to open the mold. However, if the flat passage portions 11*b*, 11*c* having a cross-sectional shape extending flat from both edges 11*a*1, 11*a*2 of the curved passage portion 11*a* are formed, it is easy to open the mold, so that the productivity of the compressor housing 1 is improved.

Although in the first embodiment, the flat passage portions 11*b*, 11*c* extend form both edges 11*a*1, 11*a*2 of the curved passage portion 11*a*, the present invention is not limited to this embodiment. The flat passage portion 11*b* or 11*b* may extend from one of the edges 11*a*1, 11*a*2, or the outer cooling passage 11 may include only the curved passage portion 11*a*.

Although in the first embodiment, cooling water is configured to flow through the outer cooling passage 11 and then the inner cooling passage 12, the present invention is not limited to this embodiment. Cooling water may flow through the inner cooling passage 12 and then the outer cooling passage 11. In the case where cooling water flows through the inner cooling passage 12 and then the outer cooling passage 11, the first communication hole 5*a* and the second communication hole 6*b* are connected by the connection pipe 7.

Second Embodiment

Next, a compressor housing according to the second embodiment will be described. The compressor housing according to the second embodiment is a modification of the first embodiment in that the shape of the inner cooling passage 12 is changed. In the second embodiment, the same constituent elements as those in the first embodiment are associated with the same reference numerals and not described again in detail.

Figure 6:
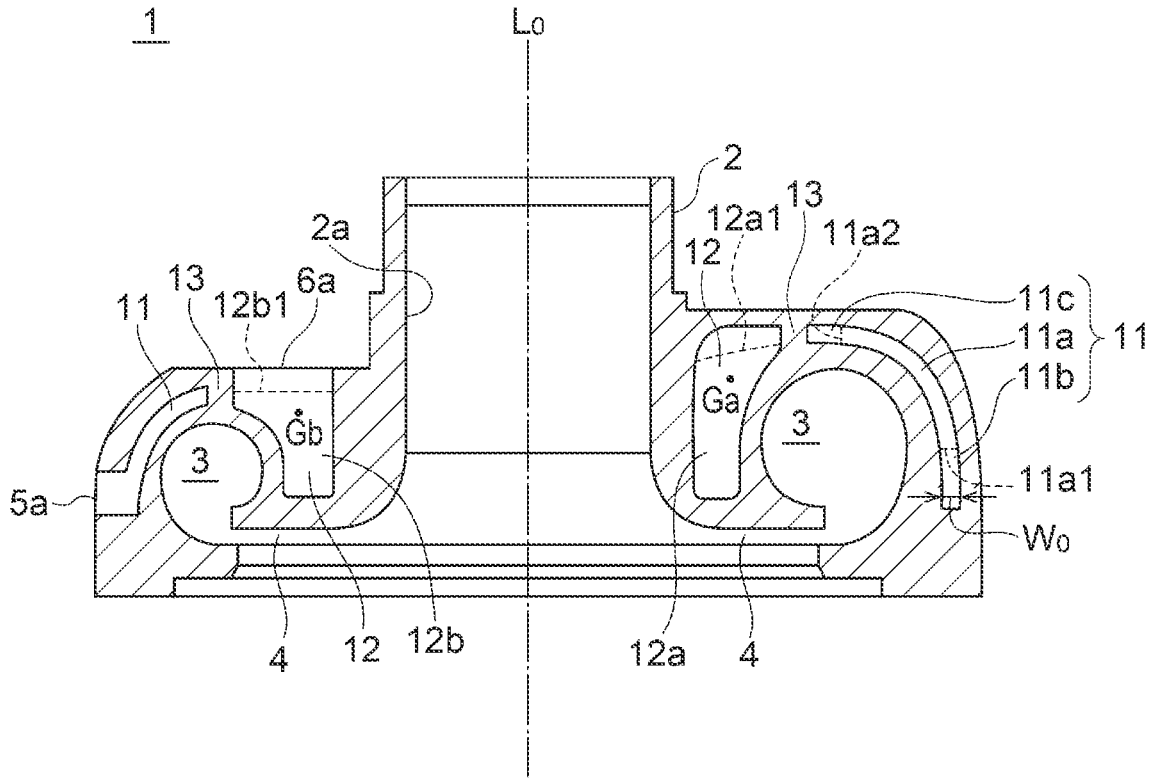
FIG. 6 is a cross-sectional view of a compressor housing according to the second embodiment of the present disclosure.

As shown in FIG. 6, in each of the cross-sections 12*a*, 12*b*, a maximum portion 12*a*1, 12*b*1 of the width of the inner cooling passage 12 is positioned on a side opposite to the diffuser passage 4 with respect to the gravity center position $G_a$, $G_b$. The configuration is otherwise the same as that of the first embodiment.

With the configuration in the second embodiment, since a portion of the inner cooling passage 12 with a maximum cooling area (maximum portion 12*a*1, 12*b*1) is positioned along the cross-sectional shape of the scroll passage 3, and the cooling area is also effective for the diffuser passage 4, the compressed air cooling effect is improved. Thus, it is possible to efficiently cool the compressed air.

Third Embodiment

Next, a compressor housing according to the third embodiment will be described. The compressor housing according to the third embodiment is a modification of the first embodiment in that the shape of the inner cooling passage 12 is changed. In the third embodiment, the same constituent elements as those in the first embodiment are associated with the same reference numerals and not described again in detail.

Figure 7:
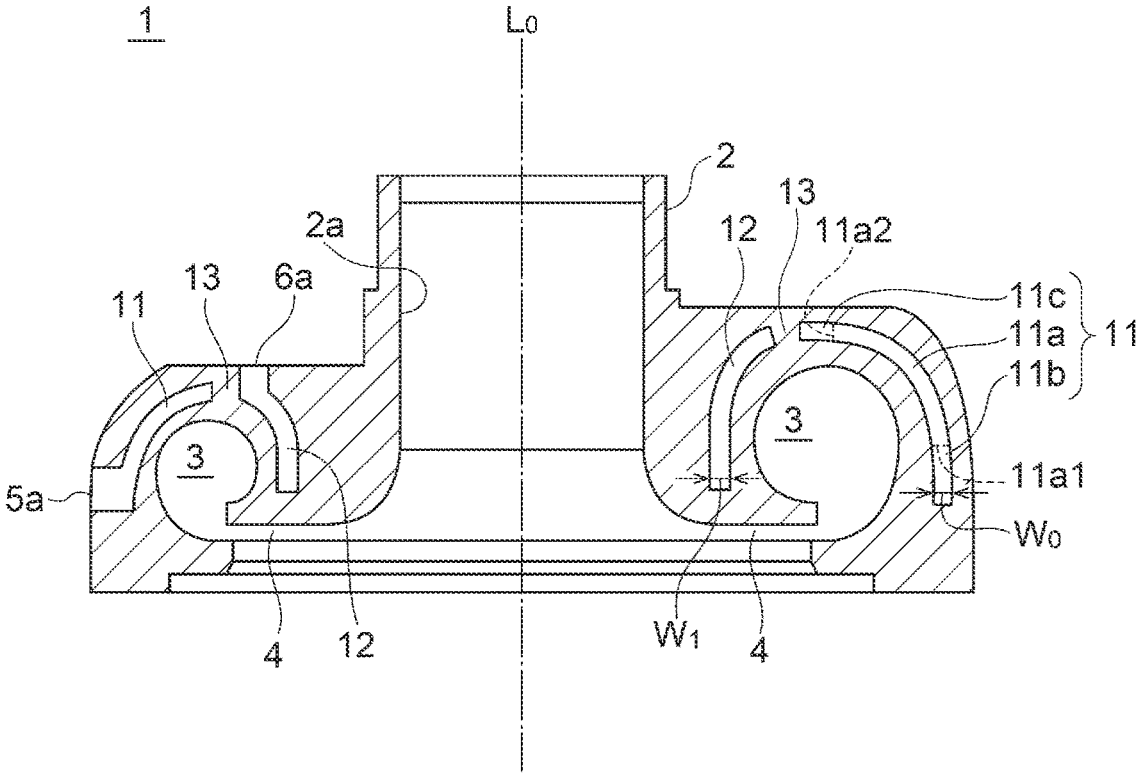
FIG. 7 is a cross-sectional view of a compressor housing according to a third embodiment of the present disclosure.

As shown in FIG. 7, the inner cooling passage 12 has a cross-sectional shape curved along the cross-sectional shape of the scroll passage 3. Each of the outer cooling passage 11 and the inner cooling passage 12 has a constant width $W_0$, $W_1$ along the cross-sectional shape of the scroll passage 3. The widths $W_0$, $W_1$ are equal to each other ($W_0=W_1$). The configuration is otherwise the same as that of the first embodiment. Although in the third embodiment, the widths of the outer cooling passage 11 and the inner cooling passage 12 are constant at $W_0$, $W_1$, respectively, in other embodiments, the width of at least one of the outer cooling passage 11 or the inner cooling passage 12 may vary in the direction along the cross-sectional shape of the scroll passage 3.

With the configuration in the third embodiment, since the widths of the outer cooling passage 11 and the inner cooling passage 12 are equal to each other, it is possible to reduce the pressure loss occurring when cooling water flows from the outer cooling passage 11 into the inner cooling passage 12. Thus, stagnation of the cooling water is reduced, and the flow is made uniform. Consequently, it is possible to efficiently cool the compressed air.

Additionally, since the inner cooling passage 12 has a cross-sectional shape curved along the cross-sectional shape of the scroll passage 3, the distance between the inner cooling passage 12 and the scroll passage 3 is reduced as much as possible along the cross-sectional shape of the scroll passage 3. Thus, it is possible to efficiently cool the compressed air.

Figure 8:
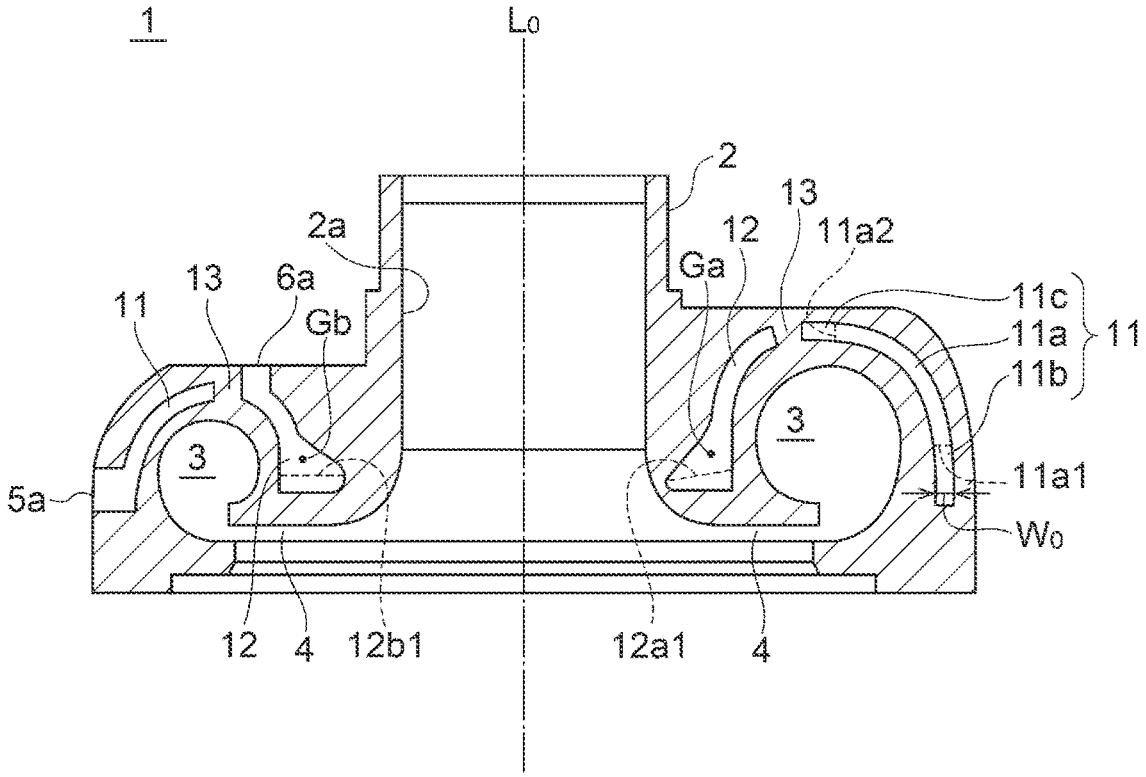
FIG. 8 is a cross-sectional view of a modification of the compressor housing according to the third embodiment of the present disclosure.

As shown in FIG. 8, the inner cooling passage 12 in the third embodiment may be shaped such that the maximum portion 12*a*1, 12*b*1 is positioned on a side of the diffuser passage 4 with respect to the gravity center position $G_a$, $G_b$. With this embodiment, it is possible to efficiently cool the compressed air in the scroll passage 3, and it is also possible to improve the cooling effect for the compressed air in the diffuser passage 4.

However, in the embodiment shown in FIG. 8, since the cross-sectional area closer to the diffuser passage 4 is larger and has smaller pressure loss, the flow of cooling water may be biased toward the diffuser passage 4. In order to avoid such a biased distribution of cooling water, as in the second embodiment shown in FIG. 6, the maximum portion 12*a*1, 12*b*1 is preferably positioned on a side opposite to the diffuser passage 4 with respect to the gravity center position $G_a$, $G_b$.

Fourth Embodiment

Next, a compressor housing according to the fourth embodiment will be described. The compressor housing according to the fourth embodiment is a modification of the first to third embodiments in that the connection relationship between the outer cooling passage 11 and the inner cooling passage 12 is changed. The following embodiment will be described based on the third embodiment with a modified connection relationship between the outer cooling passage 11 and the inner cooling passage 12. However, the embodiment may be obtained by modifying the connection relationship between the outer cooling passage 11 and the inner cooling passage 12 in the first or second embodiment. In the fourth embodiment, the same constituent elements as those in the first to third embodiments are associated with the same reference numerals and not described again in detail.

Figure 9:
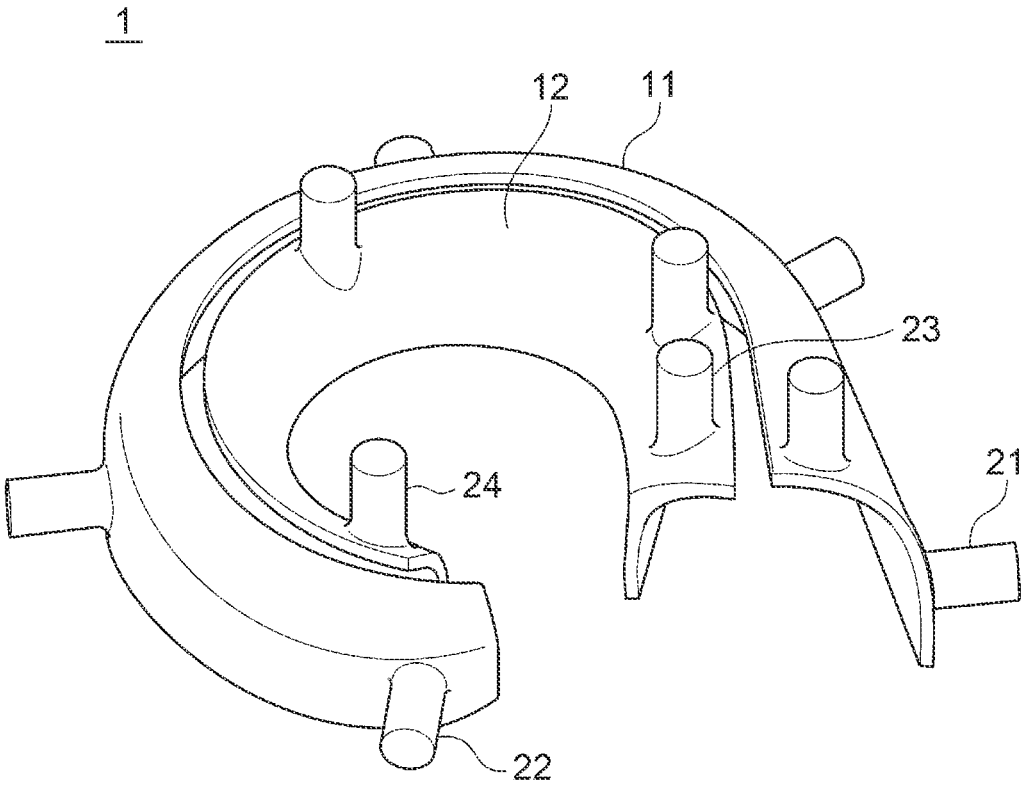
FIG. 9 is a perspective view of an outer cooling passage and an inner cooling passage formed in a compressor housing according to a fourth embodiment of the present disclosure.

As shown in FIG. 9, cooling water enters the outer cooling passage 11 via an inlet 21 and then flows through and out of the outer cooling passage 11 via an outlet 22. Further, cooling water other than the cooling water flowing through the outer cooling passage 11 enters the inner cooling passage 12 via an inlet 23 and then flows through and out of the inner cooling passage 12 via an outlet 24. This embodiment is different from the first embodiment in that the outlet 22 does not communicate with the inlet 23. The configuration is otherwise the same as that of the first embodiment.

In the fourth embodiment, since cooling water separately flows through the outer cooling passage 11 and the inner cooling passage 12, the cooling performance for the compressed air in the scroll passage 3 (see FIG. 7) is improved. Thus, it is possible to more efficiently cool the compressed air.

Fifth Embodiment

Next, a compressor housing according to the fifth embodiment will be described. The compressor housing according to the fifth embodiment is a modification of the first to third embodiments in that the connection relationship between the outer cooling passage 11 and the inner cooling passage 12 is changed. The following embodiment will be described based on the third embodiment with a modified connection relationship between the outer cooling passage 11 and the inner cooling passage 12. However, the embodiment may be obtained by modifying the connection relationship between the outer cooling passage 11 and the inner cooling passage 12 in the first or second embodiment. In the fifth embodiment, the same constituent elements as those in the first to third embodiments are associated with the same reference numerals and not described again in detail.

Figure 10:
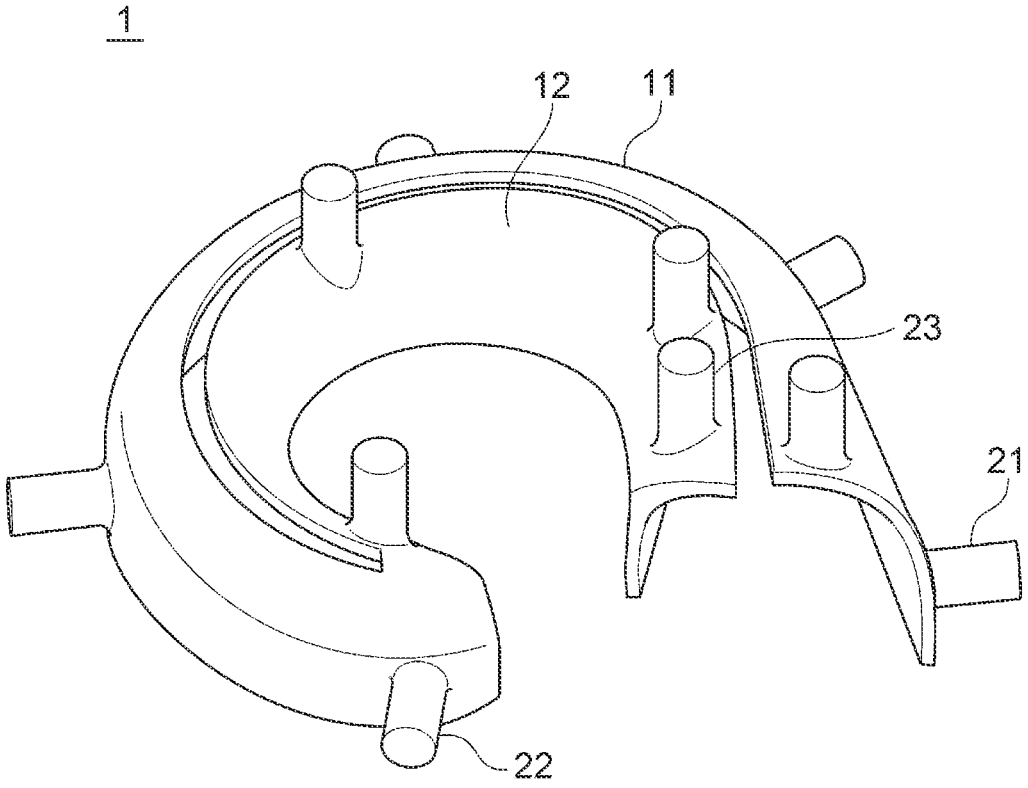
FIG. 10 is a perspective view of an outer cooling passage and an inner cooling passage formed in a compressor housing according to a fifth embodiment of the present disclosure.

As shown in FIG. 10, the outer cooling passage 11 and the inner cooling passage 12 are connected on the downstream side so that cooling water flowing into and through the outer cooling passage 11 via an inlet 21 and cooling water flowing into and through the inner cooling passage 12 via an inlet 23 are discharged from a single outlet 22. That is, an outlet of the outer cooling passage 11 joined with an outlet of the inner cooling passage 12. The configuration is otherwise the same as that of the first embodiment.

Since the outer cooling passage 11 and the inner cooling passage 12 share the single outlet 22, it is possible to reduce the cost of a core used for casting the compressor housing 1, and it is possible to improve the core holding capacity, compared with the case where each of the outer cooling passage 11 and the inner cooling passage 12 has an inlet and an outlet.

Further, in the fifth embodiment, like the fourth embodiment, since cooling water separately flows through the outer cooling passage 11 and the inner cooling passage 12, the cooling performance for the compressed air in the scroll passage 3 (see FIG. 7) is improved. Thus, it is possible to more efficiently cool the compressed air.

Sixth Embodiment

Next, a compressor housing according to the sixth embodiment will be described. The compressor housing according to the sixth embodiment is a modification of the first to third embodiments in that the connection relationship between the outer cooling passage 11 and the inner cooling passage 12 is changed. The following embodiment will be described based on the third embodiment with a modified connection relationship between the outer cooling passage 11 and the inner cooling passage 12. However, the embodiment may be obtained by modifying the connection relationship between the outer cooling passage 11 and the inner cooling passage 12 in the first or second embodiment. In the sixth embodiment, the same constituent elements as those in the first to third embodiments are associated with the same reference numerals and not described again in detail.

Figure 11:
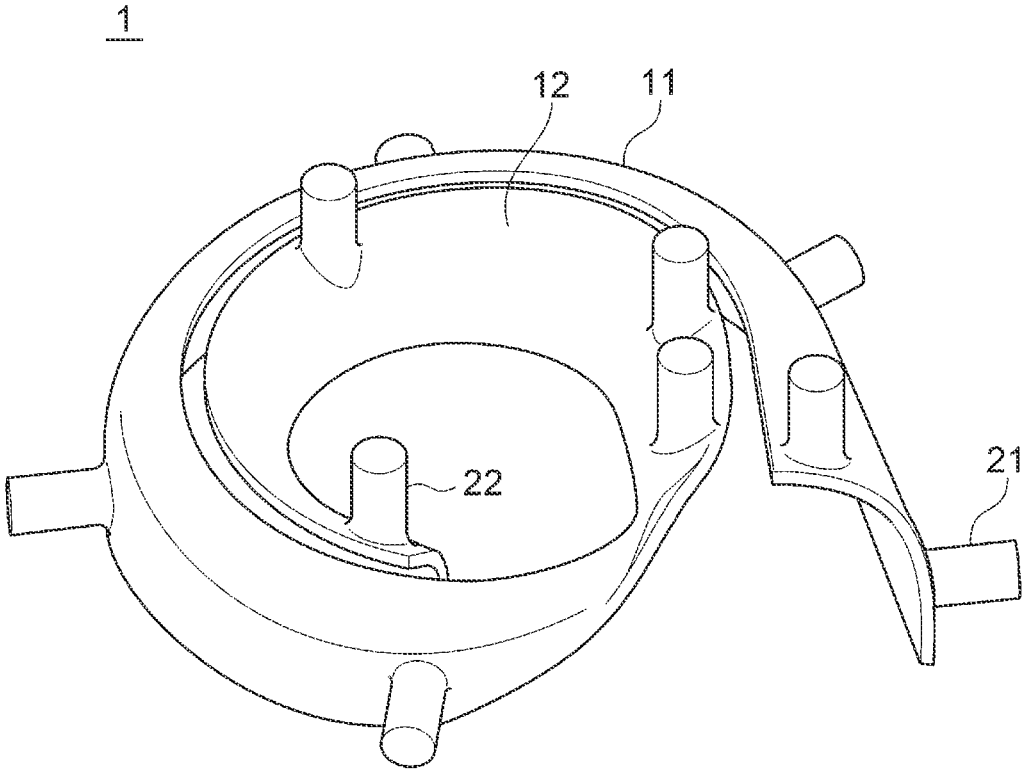
FIG. 11 is a perspective view of an outer cooling passage and an inner cooling passage formed in a compressor housing according to a sixth embodiment of the present disclosure.

As shown in FIG. 11, a downstream end of the outer cooling passage 11 is directly connected to an upstream end of the inner cooling passage 12 so that cooling water flowing into and through the outer cooling passage 11 via an inlet 21 flows into and through the inner cooling passage 12 and then are discharged from an outlet 22. The configuration is otherwise the same as that of the first embodiment.

Since the downstream end of the outer cooling passage 11 is directly connected to the upstream end of the inner cooling passage 12, without using either a connection pipe connecting the inlet of the outer cooling passage 11 to the outlet of the inner cooling passage 12 or a connection pipe connecting the outlet of the outer cooling passage 11 to the inlet of the inner cooling passage 12, the outer cooling passage 11 and the inner cooling passage 12 can form a single continuous cooling passage. Thus, it is possible to downsize the turbocharger.

Although in the sixth embodiment, cooling water is configured to flow through the outer cooling passage 11 and then the inner cooling passage 12, the present invention is not limited to this embodiment. Cooling water may flow through the inner cooling passage 12 and then the outer cooling passage 11. In the case where cooling water flow through the inner cooling passage 12 and then the outer cooling passage 11, the component indicated by the reference numeral 22 is the inlet of the cooling water, and the component indicated by the reference numeral 21 is the outlet of the cooling water.

Although in the first to sixth embodiments, a coolant flowing through the outer cooling passage 11 and the inner cooling passage 12 is cooling water, the coolant is not limited to cooling water. As the coolant, any liquid such as oil or any gas such as air may be used.

REFERENCE SIGNS LIST

1 Compressor housing
2 Air inlet part
2*a* Air passage
3 Scroll passage
4 Diffuser passage
5*a*, 5*b*, 5*c*, 5*d* First communication hole
6*a*, 6*b*, 6*c*, 6*d* Second communication hole
7 Connection pipe
8 Outer cooling passage
11*a* Curved passage portion
11*a*1, 11*a*2 Edge (of curved passage portion)
11*b*, 11*c* Flat passage portion
12 Inner cooling passage
12*a*, 12*b* Cross-section (of inner cooling passage)
12*a*1, 2*b*1 Maximum portion
13 Separation wall
21 Inlet
22 Outlet
23 Inlet
24 Outlet
G, $G_a$, $G_b$ Gravity center position (of cross-section of inner cooling passage)
$L_0$ Rotational axis of compressor wheel
L, $L_1$, $L_2$ Reference longitudinal direction
$W_0$ Width (of outer cooling passage)
$W_a$, $W_b$ Width (of maximum portion)
$\theta_1$, $\theta_2$ Angle

The invention claimed is:

1. A compressor housing accommodating a compressor wheel for compressing intake air supplied to an engine, wherein the compressor housing has therein:

an outer cooling passage extending along a circumferential direction on an outer circumferential side of a scroll passage of a spiral shape through which the intake air compressed by the compressor wheel flows;

an inner cooling passage extending along the circumferential direction on an inner circumferential side of the scroll passage, the inner cooling passage being separated from the outer cooling passage by a separation wall extending along the circumferential direction, and wherein when, in a cross-section along a rotational axis of the compressor wheel, a linear direction which passes through a gravity center position of a cross-section of the inner cooling passage and in which the cross-section of the inner cooling passage has a maximum length is defined as a reference longitudinal direction, the reference longitudinal direction is a direction along the rotational axis of the compressor wheel.

2. The compressor housing according to claim 1, wherein the outer cooling passage includes a curved passage portion having a cross-sectional shape curved along a cross-sectional shape of the scroll passage in a cross-section along a rotational axis of the compressor wheel.

3. The compressor housing according to claim 2, wherein the outer cooling passage further includes a flat passage portion having a cross-sectional shape extending flat from at least one of both edges of the curved passage portion in a direction along the cross-sectional shape of the scroll passage in the cross-section along the rotational axis of the compressor wheel.

4. The compressor housing according to claim 1, wherein the inner cooling passage has a cross-sectional shape curved along a cross-sectional shape of the scroll passage in a cross-section along a rotational axis of the compressor wheel.

5. The compressor housing according to claim 1, wherein the compressor housing further has therein a diffuser passage communicating with the scroll passage and extending inward in a radial direction of the compressor wheel from the scroll passage, and wherein, when a direction perpendicular to the reference longitudinal direction is defined as a width direction, a maximum portion of the inner cooling passage in the width direction is positioned on a side of the diffuser passage with respect to the gravity center position.

6. The compressor housing according to claim 1, wherein the compressor housing further has therein a diffuser passage communicating with the scroll passage and extending inward in a radial direction of the compressor wheel from the scroll passage, and wherein, when a direction perpendicular to the reference longitudinal direction is defined as a width direction, a maximum portion of the inner cooling passage in the width direction is positioned on a side opposite to the diffuser passage with respect to the gravity center position.

7. The compressor housing according to claim 1, wherein a width of the inner cooling passage in a direction perpendicular to the reference longitudinal direction is equal to or larger than that of the outer cooling passage.

8. The compressor housing according to claim 1, comprising:

at least two first communication holes connecting the outer cooling passage to outside of the compressor housing; and at least two second communication holes connecting the inner cooling passage to outside of the compressor housing.

9. The compressor housing according to claim 8, wherein at least one of the at least two first communication holes and the at least two second communication holes opens vertically upward when the compressor housing is attached to the engine.

10. The compressor housing according to claim 8, wherein openings of the first communication holes make a 90-degree angle with openings of the second communication holes.

11. The compressor housing according to claim 8, wherein one of the at least two first communication holes is an inlet of a coolant flowing through the outer cooling passage, and another one of the at least two first communication holes is an outlet of the coolant flowing through the outer cooling passage, and wherein one of the at least two second communication holes is an inlet of a coolant flowing through the inner cooling passage, and another one of the at least two second communication holes is an outlet of the coolant flowing through the inner cooling passage.

12. The compressor housing according to claim 1, wherein an outlet of a coolant flowing through the outer cooling passage is joined with an outlet of a coolant flowing through the inner cooling passage.

13. The compressor housing according to claim 1, wherein an inlet of a coolant flowing through the outer cooling passage is directly connected to an outlet of a coolant flowing through the inner cooling passage, or an outlet of a coolant flowing through the outer cooling passage is directly connected to an inlet of a coolant flowing through the inner cooling passage.

14. A turbocharger comprising a compressor housing accommodating a compressor wheel for compressing intake air supplied to an engine, wherein the compressor housing has therein:

an outer cooling passage extending along a circumferential direction on an outer circumferential side of a scroll passage of a spiral shape through which the intake air compressed by the compressor wheel flows;

an inner cooling passage extending along the circumferential direction on an inner circumferential side of the scroll passage, the inner cooling passage being separated from the outer cooling passage by a separation wall extending along the circumferential direction, and wherein when, in a cross-section along a rotational axis of the compressor wheel, a linear direction which passes through a gravity center position of a cross-section of the inner cooling passage and in which the cross-section of the inner cooling passage has a maximum length is defined as a reference longitudinal direction, the reference longitudinal direction is a direction along the rotational axis of the compressor wheel.

* * * * *